US009227291B2

(12) United States Patent
Scholz

(10) Patent No.: US 9,227,291 B2
(45) Date of Patent: Jan. 5, 2016

(54) ANGLE GRINDER

(71) Applicant: MAKITA CORPORATION, Aichi (JP)

(72) Inventor: Klaus Scholz, Hamburg (DE)

(73) Assignee: MAKITA CORPORATION, Aichi (JP)

( * ) Notice: Subject to any disclaimer, the term of this patent is extended or adjusted under 35 U.S.C. 154(b) by 0 days.

(21) Appl. No.: 14/231,835

(22) Filed: Apr. 1, 2014

(65) Prior Publication Data

US 2015/0004885 A1 Jan. 1, 2015

(30) Foreign Application Priority Data

Apr. 3, 2013 (DE) ..... 20 2013 101 420

(51) Int. Cl.

| | |
|---|---|
| ***B24B 23/02*** | (2006.01) |
| ***B24B 27/08*** | (2006.01) |
| ***B25F 5/02*** | (2006.01) |
| ***B27B 9/02*** | (2006.01) |

(52) U.S. Cl.

CPC ..... *B24B 27/08* (2013.01); *B24B 23/028* (2013.01); *B25F 5/021* (2013.01); *B27B 9/02* (2013.01)

(58) Field of Classification Search

CPC ..... B24B 23/02; B24B 23/028; B24B 41/04; B24B 55/052; B25F 5/02; B27B 9/02

USPC ..... 451/358, 359, 44

See application file for complete search history.

(56) References Cited

U.S. PATENT DOCUMENTS

| | | | | |
|---|---|---|---|---|
| 4,633,621 | A * | 1/1987 | Weber | 451/461 |
| 5,540,210 | A * | 7/1996 | Jones | 125/13.01 |
| 5,766,062 | A * | 6/1998 | Edling | 451/451 |
| 6,893,334 | B1 * | 5/2005 | Stivers | 451/359 |
| 7,213,591 | B2 * | 5/2007 | Nomoto et al. | 125/13.01 |
| 8,616,190 | B2 * | 12/2013 | Tadokoro et al. | 125/13.01 |
| 2005/0250429 | A1 * | 11/2005 | Nomoto et al. | 451/359 |

FOREIGN PATENT DOCUMENTS

| | | |
|---|---|---|
| DE | 102005049766 | 4/2007 |
| DE | 202008000299 | 3/2008 |
| WO | 2013/029063 | 2/2013 |

* cited by examiner

*Primary Examiner* — George Nguyen

(74) *Attorney, Agent, or Firm* — Greenblum & Bernstein, P.L.C.

(57) ABSTRACT

An angle grinder is provided and may include a cutting arm on which a tool may be mounted in a rotating manner about an axis of the grinder and a guide element that is arranged on the axis to control a cutting depth of the tool during a workpiece cutting operation.

6 Claims, 2 Drawing Sheets

ANGLE GRINDER

Figure 1:
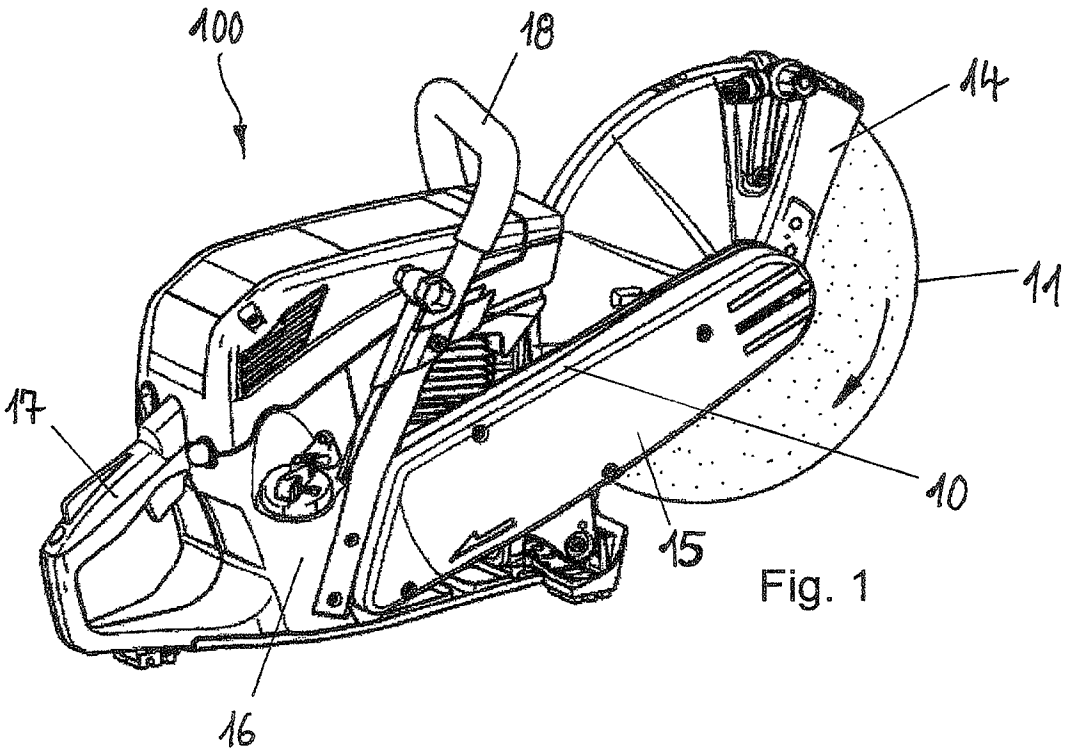

The present invention relates to an angle grinder with a cutting arm, on which a tool is held in rotating manner about an axis.

PRIOR ART

DE 10 2005 049 766 B4 discloses, for example, an angle grinder with a cutting arm, and at the end of the cutting arm a tool is held that rotates about an axis. The cutting arm projects out of the body of the angle grinder and within the body of the angle grinder a motor is accommodated which serves to drive the tool in a rotating manner. For this a belt is guided in the cutting arm which is protected against contacting and soiling by means of a belt cover. In the forward, free area of the cutting arm an axis, about which the tools is held in a rotating manner, runs perpendicularly to the direction in which the cutting arm extends.

The tool is formed by a grinding disc which rotates in a vertical plane and with regard to which the axis for holding the tools runs perpendicularly. The cutting arm and the belt cover surround a bearing arrangement for holding the tool in a rotating manner, whereby various clamping elements are also provided for the removable mounting of the tool on the hub of the tool. A protective hood is also arranged on the cutting arm which surrounds the tool on the side facing in the direction of the user in an approximately semi-circular manner. The tool can thus be used with the segment of the disc projecting from the open area of the protective hood.

When using the angle grinder, for example for cutting stone materials, the tool can penetrate so far into the workpiece until the surface of the workpiece comes into contact with the free end of the cutting arm, which will be referred to as deep cutting below. At the same time the angle grinder must be able to move forwards, whereby frequently the end of the cutting arm or the fastenings for mounting the tools scape over the surface of the workpiece and can incur damage. Although separate discs or protective and guiding elements are often arranged on the cutting arm, these can, however, also be damaged when using the angle grinder. In particular, this produces the drawback that on introducing a forward movement into the angle grinder during deep cutting, either the end of the cutting arm or other guiding and protective elements have to scrape over the surface of the workpiece, through which the ability to operate the angle grinder is negatively affected.

DISCLOSURE OF THE INVENTION

The aim of the invention is to further develop an angle grinder with a cutting arm in such a way that operation of the angle grinder is improved during the deep cutting of workpieces. More particularly, the objective is to create improved guide means for the angle grinder when deep cutting in a workpiece that are particularly robustly designed.

This is achieved on the basis of an angle grinder with a cutting arm in accordance with the introductory section of claim 1 in conjunction with the characterising features. Advantageous further embodiments are set out in the dependent claims.

The invention includes the technical teaching that a guide element is mounted on the axis through which the cutting depth with which the tool cuts into a workpiece during operation can be restricted.

In accordance with the invention, by arranging a guide element on the axis in which the tool of the angle grinder is also mounted a robust, resilient guide means is formed, and it can be effectively prevented that when being, cut by the tool the workpiece comes into contact with the cutting arm. More particularly, the guide element can be designed so that through it the cutting depth with which the tool can cut into a workpiece during operation is limited.

Consequently a separate guide element does not have to be applied, in the belt cover for example, and this thereby also avoids pressure forces against the guide element being introduced into the belt cover. In accordance with the invention contact forces against the guide element are transferred via the axis into the cutting arm of the angle grinder, and the axis is already very robust and resilient due to the tool holder. Here, the term axis denotes the spatial axis about which the tool can rotate, and at the same time axis also denotes the structural drive shaft on which the tool is mounted.

Particularly beneficially the guide element can be arranged adjacent to the tool on the axis. This produces the advantage that even in the case of a very narrow workpiece section at the side of the tool the guide element can contact the surface of the workpiece. More particularly, however, between the tool and the guide element in the axial direction a gap can remain to avoid the guide element laterally contacting the tool. The adjacent arrangement thus describes an arrangement in which at least no further functional element is arranged between the tool and guide element on the axis.

According to a particularly advantageous further development of the angle grinder in accordance with the invention, the guide element can be designed as a guide roller, more particularly rotation-symmetrically. The guide element can be mounted in a freely rotating manner on the axis. Through this it is advantageously achieved that during deep cutting when operating the angle grinder, in which the surface of the workpiece comes into contact with the guide roller, the angle grinder can roll along the surface of the workpiece by way of the guide roller. This avoids the scraping of a stop attached to the cutting arm along on the surface of the workpiece in a friction-affected manner, which is countered by the surface of the workpiece. As a result of this, during deep cutting the angle grinder can be guided through the workpiece considerably more quietly.

The guiding effect of the guide element is achieved in particular in that the guide element has a diameter which is determined so that the guide element projects beyond the cutting arm in relation to the axis. It can be sufficient if the guide element only projects slightly beyond the radial outermost point of the cutting arm or the fastening means for mounting the tool on the axis. Irrespective of the angle with which the angle grinder is held over the workpiece the guide element fundamentally comes into contact with the surface of the workpiece first and it can be effectively prevented that the cutting arm comes into contact with the workpiece. Particularly in the case of greater contact forces these are not transmitted into the cutting arm or the belt cover, but even large contact forces can be effectively transmitted via the guide element onto the axis and subsequently into the cutting arm.

In accordance with a preferred variant the guide element can be made of a metallic material, more particularly a steel material. It can also be envisaged that, for example, the outer surface of the guide element designed as a roller can be provide with a knurled surface or suchlike.

The guide element can be mounted in a freely rotating manner on the axis through a roller bearing, through a slide bearing, or for example on a plastic ring. The guide element must be borne on the axis in such a way as to bring about both radial bearing as well as axial guiding for the guide element. For example, roller bearings can be provided with which the guide element is held in rotatable manner on the axis both axially and radially. It is important that the guide element can rotate independently of the tool on the axis. Particularly when during deep cutting the guide element comes into contact with the surface of the workpiece and when the angle grinder is being moved along the surface of the workpiece with the guide element, the guide element performs very slow rotary movement, while the tool rotates at operating speed in its rotational plane.

In accordance with another form of embodiment of the angle grinder a protective hood can be arranged on the cutting arm, whereby the guide element can be mounted on the axis within the protective hood, so that the protective hood laterally surrounds the guide element. In accordance with a modification of the invention a further guide element can also be arranged in the same way at the side of the tool, with a first guide element located on a first side of the tool and a further guide element located on the opposite side of the tool. Both guide elements can be mounted on the axis inside the protective hood, wherein the protective hood must be designed so that at least one angle segment of the guide element projects from the edge of the protective hood.

PREFERRED EXAMPLE OF EMBODIMENT OF THE INVENTION

Figure 3:
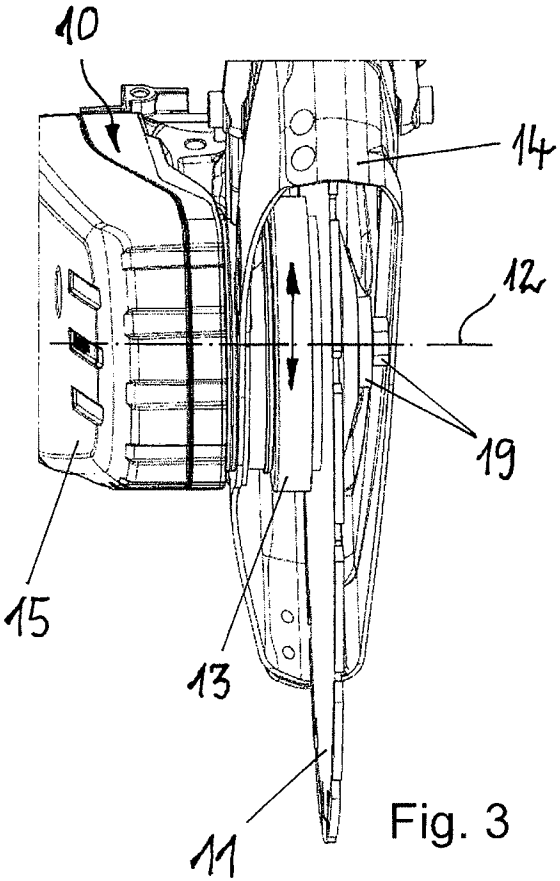
Figure 2:
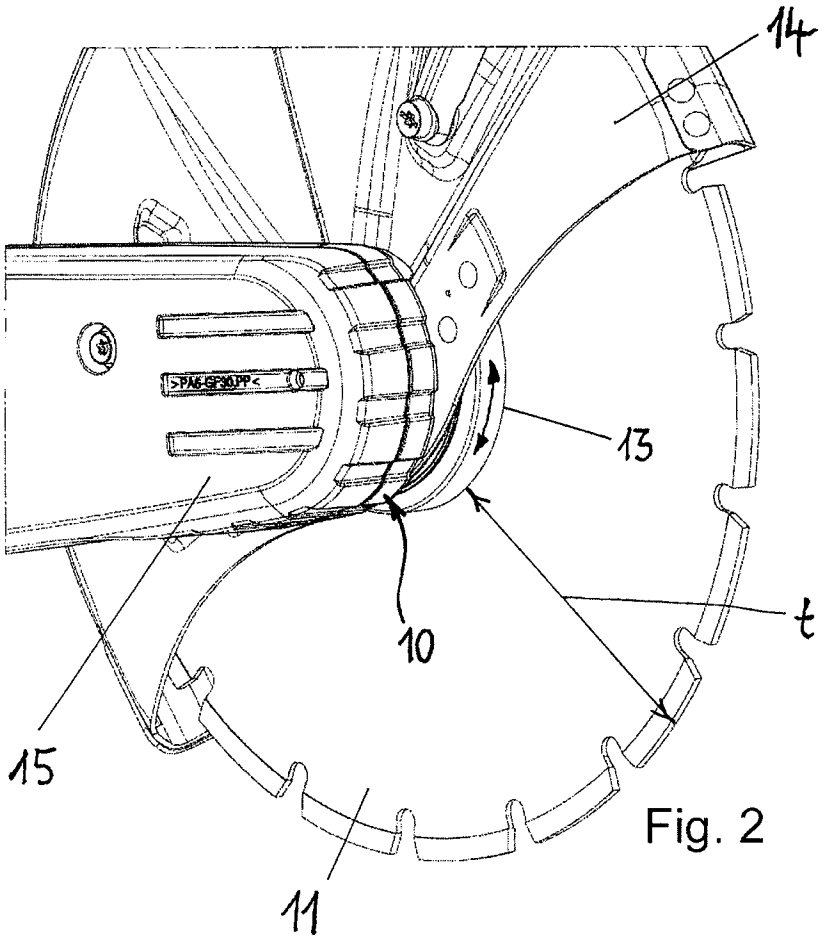

Further measures improving the invention are set out in more detail below together with a description of a preferred example of embodiment of the invention with the aid of the figures, wherein:

FIG. 1 shows a perspective view of an angle grinder with a cutting arm, on which a tool is mounted in a rotating manner about an axis, FIG. 2 shows a detailed view of the cutting arm with the tool mounted in the cutting arm, as well as a guide element in accordance with the invention and FIG. 3 shows a front view of the cutting arm with the tool mounted on the cutting arm as well as the guide element in accordance with the present invention.

In a perspective view FIG. 1 shows an angle grinder 100 with a cutting arm 10, on which a tool 11 is mounted in a rotating manner. The angle grinder 100 has a basic body 16, in which a motor is accommodated. Via a belt running through the cutting arm 10 the tool 11 is made to rotate by the motor. In order to guide the angle grinder 100 manually, handles 17 and 18 are provided, by means of which a user can guide the angle grinder 100 by hand. A partial segment of the tool 11 is protected with a protective hood 14 which laterally surrounds the tool 11 and the cover it in the rotational plane of the tool 11 facing the user of the angle grinder 100. In conjunction with following FIGS. 2 and 3 the embodiment of the angle grinder 100 in accordance with the invention with a guide element 13 at the end of the cutting arm 10 is described in more detail.

FIG. 2 shows the free end of the cutting arm 10 of the angle grinder 100, on which a tool 11 is mounted in a rotating manner, and FIG. 3 shows a front view of the cutting arm 10 with the tool 11. The tool 10 is in the form of a grinding disc and rotates about an axis 12, in which the tool 11 is mounted in a rotatable manner at the end of the cutting arm 10. Through fastening means 19 the tool 11 is mounted on a drive shaft, which extends along the axis 12 and is driven by means of a belt, which runs, in a not visible manner, within the cutting arm 10, wherein the cutting arm 10 comprises a belt cover 15, and, formed in the cutting arm 10 and the belt cover 15, is a belt space in which the belt can run.

In accordance with the invention, adjacent to the tool 11, a guide element 13 in the form of a guide roller 13 is mounted on the axis. The double arrows indicates that the guide roller 13 can freely rotate about the axis 12, and in a manner not shown in more detail, the guide roller 12 is also borne by means of a bearing arrangement on the drive shaft for driving the tool 11. The guide roller 13 has a diameter that is greater than the radial dimensions of the cutting arm 10 and the belt cover 15 in relation to the axis 12. With this it is achieved that when the tool 10 cuts into a workpiece with a cutting depth t, shown in FIG. 2, during deep cutting the surface of the workpiece is always in contact with the guide roller 13, without the cutting arm 10 or the belt cover 15 contacting the workpiece first. It is also shown that the fastening means 19 for mounting the tool on the drive shaft on the cutting arm 10 has a smaller diameter than the guide roller 13 in order to prevent the fastening means 19 coming into contact with the workpiece.

A protective hood 14 is arranged over the tool 11, whereby the protective hood 13 laterally surrounds the tool 11 and is also mounted on the cutting arm 10. The guide roller 13 is arranged inside the protective hood 14 on the axis 12, and the guide roller 13 has an angle segment with which it projects from the protective hood 14, wherein the angle segment is the same angle segment with which the tool 11 projects from the protective hood 14. Consequently, irrespective of the angle a user holds the angle grinder 100 when guiding it through a workpiece, the guide roller 13 can fulfil its task of coming into contact with surface of the workpiece.

In its implementation the invention is not restricted to the preferred example of embodiment described above. Rather, a number of variants are conceivable which make use of the illustrated solution even with fundamentally different embodiments. All the features and/or advantages, derived from the claims, the description or the drawings, including structural details, spatial arrangements and processing steps can be essential to the invention in themselves and also in the most varied of combinations.

LIST OF REFERENCES

100 Angle grinder
10 Cutting arm
11 Tool
12 Axis
13 Guide element, guide roller
14 Protective hood
15 Belt cover
16 Basic body
17 Handle
18 Handle
19 Fastening means
t Cutting depth

The invention claimed is:

1. An angle grinder comprising:

a cutting arm, on which a tool is mounted in a rotating manner about an axis; and a guide element arranged on the axis such that a cutting depth with which the tool cuts into a workpiece during operation is limited, wherein a protective hood is arranged on the cutting arm, a gap is provided between the tool and the guide element in the axial direction, the guide element is mounted on the axis inside the protective hood, the guide element has a diameter that is determined in such a way that the guide element radially projects from the cutting arm in relation to the axis, the guide element has an angle segment with which the guide element projects from the protective hood, and the angle segment is the same angle segment with which the tool projects from the protective hood.

2. The angle grinder according to claim 1, wherein the guide element is arranged on the axis adjacent to the tool.

3. The angle grinder according to claim 1, wherein the guide element is a guide roller and is rotationally symmetrical.

4. The angle grinder according to claim 1, wherein the guide element is mounted in a freely rotating manner on the axis.

5. The angle grinder according to claim 1, wherein the guide element is made of a steel material.

6. The angle grinder according to claim 1, wherein the guide element is mounted in a freely rotatable manner on the axis by one of a roller bearing, a slide bearing or a plastic ring.

* * * * *